US005153957A

United States Patent [19]

Price, Sr.

[11] Patent Number: 5,153,957

[45] Date of Patent: Oct. 13, 1992

[54] COVER ASSEMBLY FOR A MATTRESS

[76] Inventor: Henry L. Price, Sr., 8127 Salt Lake Dr., Baltimore, Md. 21207

[21] Appl. No.: 631,895

[22] Filed: Dec. 21, 1990

[51] Int. Cl.[5] ..... A47G 9/02

[52] U.S. Cl. ..... 5/500; 5/482; 5/497

[58] Field of Search ..... 5/492, 495, 496, 497, 5/498, 499, 500, 502

[56] References Cited

U.S. PATENT DOCUMENTS

| | | | |
|---|---|---|---|
| 3,377,636 | 4/1968 | Di Addario | 5/499 |
| 4,021,869 | 5/1977 | Root | 5/497 |
| 4,045,831 | 9/1977 | Clark | 5/497 |
| 4,145,778 | 3/1979 | Ferrante et al. | 5/500 |
| 4,304,018 | 12/1981 | McClam | 5/485 |

*Primary Examiner*—Alexander Grosz
*Attorney, Agent, or Firm*—Leonard Bloom

[57] ABSTRACT

A cover assembly for a mattress and a device and process for the fabrication of the cover assembly is disclosed. The cover assembly is a one-piece assembly including a bottom sheet portion, a top sheet portion and a blanket portion which are joined to one another along a fold line. The top sheet portion and the blanket portion are folded back on themselves along the fold line to provide the one-piece cover assembly with a "turned-back" look.

9 Claims, 10 Drawing Sheets

COVER ASSEMBLY FOR A MATTRESS

FIELD OF THE INVENTION

The present invention relates to cover assemblies for mattresses, as well as devices and processes for the fabrication thereof.

BACKGROUND OF THE INVENTION

Traditionally, mattresses are covered with various bedding arrangements. Ordinarily, such bedding arrangements include a bottom sheet that covers a mattress and a top sheet that covers the users body. A "full-made" bed further includes a blanket or quilt that is disposed over the top sheet for warmth.

Almost since the time that bedding was first introduced, problems have been encountered with keeping the bedding neat and straight when it is on the mattress.

Normally, use of a mattress results in the bedding becoming twisted, rumpled or otherwise misaligned or messed. Thus, to keep the bed neat, the bedding must be remade after each use of the bed. Even under ideal conditions, such remaking can be work intensive. Furthermore, when the bed is in a location where space is limited (such as a mobile home, a recreational vehicle or the cab of a truck) remaking the bed can be complicated, sometimes even requiring that the maker climb over the bed during such remaking.

Further, it is preferred that the bedding have a "turned-back" look, wherein a portion of the top sheet and the blanket are folded back on themselves towards the bottom of the mattress.

Accordingly, in many instances, such as in the cab of a tractor-trailer, while the aesthetic preferences of a fully-made "turned-back" bed are recognized, the remaking of a bed is often nonetheless considered a worthless expenditure of time and effort. Thus, the bedding is either not made or it is made with results that are less than satisfactory.

In order to aid in solving the above-mentioned problems, numerous disclosures have been made to provide bedding cover arrangements that require minimal work to be placed on a mattress. Those disclosures, of which I am aware, are enumerated as follows:

| Inventor(s) | Patent No. | Date of Issue |
|---|---|---|
| Simon | 2,139,980 | 12/13/38 |
| Wikmark | 2,449,758 | 09/21/48 |
| Temple | 2,736,043 | 02/28/56 |
| Sullivan | 2,799,870 | 07/23/57 |
| Walker | 3,879,777 | 04/29/75 |
| Root | 4,021/869 | 05/10/77 |
| Ferrante et al | 4,145,778 | 03/27/79 |
| Jaffe et al | 4,339,835 | 07/20/82 |
| Roccograndi et al | 4,386,439 | 06/07/83 |
| McClam | 4,402,098 | 09/06/83 |
| Schuetze | 4,413,368 | 11/08/83 |
| Ison | 4,546,508 | 10/15/85 |
| Prandina | 4,573,227 | 03/04/86 |
| Sulley | 4,646,376 | 03/03/87 |
| Vitale | 4,651,370 | 03/24/87. |

Unfortunately, the above-mentioned disclosures involve either single piece assemblies and/or assemblies that do not include either a bottom sheet, a top sheet and/or a blanket, all of which are necessary for giving a "fully-made" appearance to the bed. Thus, use of the above assemblies, in conjunction with either a top sheet, bottom sheet and/or blanket in order to achieve a fully-made appearance, results in a two-piece arrangement that is more difficult to place and smooth than a similar one-piece assembly.

Accordingly, it can be seen that there remains a need for a one-piece cover assembly for a mattress that includes a top sheet, a bottom sheet and a blanket, so as to simulate the appearance of a fully-made bed and, in particular, of such a fully-made bed having a "turned-back" look. It can further be seen that there remains a need for devices and processes that are useful for producing such a one-piece assembly.

SUMMARY OF THE INVENTION

It is a primary object of the present invention to provide a one-piece cover assembly for a mattress, which cover assembly includes a top sheet, a bottom sheet and a blanket, so that a fully-made bed may be simulated by the use thereof.

It is a further primary object of the present invention that such a one-piece cover assembly also provide a "turned-back" look.

It is a further object of the present invention to provide such a cover assembly that is simple to install where space is limited, such as the cab of a tractor-trailer.

It is a still further object of the present invention to provide such a cover assembly that uses a minimum amount of material, thereby facilitating its storage when not in use.

It is another primary object of the present invention to provide a device for the fabrication of such a one-piece cover assembly, which device is simple in construction and use, and which may be adjustable.

It is yet another primary object of the present invention to provide a process for the fabrication of such a one-piece cover assembly, which process is simple to carry out.

In accordance with the teachings of the present invention, a one-piece cover assembly for a mattress is disclosed that includes a top sheet portion, a bottom sheet portion and a blanket portion. The blanket portion has a width that exceeds the width of the mattress. This permits the width of the blanket portion to extend beyond the periphery of the mattress. The blanket portion further has a length exceeding the length of the mattress. This permits at least a portion of the length of the blanket portion to extend beyond at least a portion of the periphery of the mattress. The top sheet portion is disposed under the blanket portion and is laterally secured thereto along a line that extends across the width of the mattress and which is further located forwardly of the center of the mattress. In this manner, a fold line is defined that extends laterally across the width of the blanket portion. The top sheet portion also has a width that is substantially the same as, and which is substantially aligned with, the blanket portion. Finally the top sheet portion, has a length that extends rearwardly from the fold line towards the foot end of the mattress. The bottom sheet portion is disposed under the top sheet portion, being laterally secured to the blanket portion and the top sheet portion along the fold line. The bottom sheet portion has a width that is substantially the same as, and which is substantially aligned with, the blanket portion and the top sheet portion. The bottom sheet portion further has a length that extends forwardly of the fold line beyond the periphery of the top end of the mattress. Finally, at least a portion of the blanket portion and the top sheet portion are folded back on themselves along the fold line and towards the bottom of the mattress. In this manner, the "turned-back" look is provided with the folded back portion of the top sheet portion being disposed on the folded-back portion of the blanket portion.

In another embodiment, the top sheet portion and the bottom sheet portion have a length and a width substantially the same as and substantially aligned with the blanket portion. The blanket portion and the top sheet portion further have at least one pleated fold extending the length thereof such that the blanket portion and top sheet portion may be extended outwardly.

In another aspect of the present invention, a device is provided for fabricating a cover assembly for a mattress. This device includes a top surface and a bottom surface. Each of the top and bottom surfaces have substantially the sam width and length as the mattress. The top and bottom surfaces are positioned substantially parallel to one another, being spaced from one another by a distance that is substantially the same as the depth of the mattress. A spacing means is provided for spacing and securing the top and bottom surfaces substantially parallel to one another by the distance. Finally a raised member is provided. This raised member is disposed forwardly of the center of the top surface. This raised member extends horizontally across the width of the top surface and vertically between the top and bottom surfaces. In this manner, a chalk line is provided for marking a fold line in the cover assembly.

In still another aspect of the present invention, a process is disclosed for fabricating a cover assembly for a mattress. This process includes the steps of placing a blanket portion on top of a prototype of the mattress, such that a portion of the width and length of the blanket portion extends beyond at least a portion of the periphery of the prototype. A top sheet portion is placed upside down on the blanket portion, such that the top sheet portion is coincident with the top end of the prototype, and further such that the top sheet portion extends rearwardly from the top end of the prototype terminating forwardly of the center of the prototype. A bottom sheet portion is placed upside down on the blanket portion and the top sheet portion. In this fashion, the bottom sheet portion extends forwardly and extends beyond at least a portion of the periphery of the prototype. Finally, the blanket portion, the top sheet portion and the bottom sheet portion are secured to one another along a fold line that is located forwardly of the center of the prototype and which fold line extends across the width of the mattress.

In yet another embodiment, the top sheet portion and the bottom sheet portion have a length and a width substantially the same as the blanket portion. The bottom sheet portion is secured to the top sheet portion and the blanket portion about the respective edges of the portions from the fold line to the bottom end of the mattress. At least outwardly extending one pleated fold is formed longitudinally in the blanket portion and the top sheet portion.

These and other objects and advantages of the present invention will become readily apparent from a reading of the following description in conjunction with the enclosed drawings.

BRIEF DESCRIPTION OF THE DRAWINGS

FIG. 3A is an exploded perspective view of the top sheet portion joined to the blanket portion of the present invention.

FIG. 3B is an exploded perspective view of the bottom sheet portion joined to the blanket portion and the top sheet portion of the present invention.

FIG. 3C is a perspective view of the joined blanket portion and top sheet portion being folded back.

FIG. 3D is a perspective view of the present invention after the blanket portion and top sheet portion have been folded back.

FIG. 3E is a cross-section view taken across the lines 3E—3E of FIG. 3D.

FIG. 4A is an exploded perspective view of the blanket portion joined to the top sheet portion of another embodiment of the present invention.

FIG. 4B is an exploded view of the bottom sheet portion being joined to the blanket portion and the top sheet portion of FIG. 4A.

FIG. 4C is a perspective view of the embodiment of FIG. 4B showing the blanket portion and top sheet portion folded back.

FIG. 7 illustrates the upside-down positioning of the blanket portion on the prototype.

FIG. 8 illustrates the chalk lines on the assembly.

FIG. 9 illustrates removal of excess material of the corner of the blanket portion.

FIG. 10 illustrates the upside-down positioning of the top sheet portion on the blanket portion.

FIG. 11 illustrates the upside-down positioning of the bottom sheet portion on the blanket portion and the top sheet portion.

FIG. 12 illustrates the portion of the assembly being pulled towards one of the corners of the prototype for forming the corner seams therebetween.

FIG. 13 illustrates the excess material at the corners removed from the assembly.

FIG. 14 illustrates one of the corner seams formed in the assembly.

FIG. 15 illustrates removal of excess material of the top sheet portion and of the bottom sheet portion.

FIG. 16 illustrates addition of a reinforcement strip across the seam at the junction of the blanket portion and the sheet portions.

FIG. 17 is an enlarged view of FIG. 16.

FIG. 18 illustrates one of the strips of the skirt portion of the cover assembly being marked.

FIG. 19 illustrates the forming of the openings in the strips of the skirt portion for the elastic strip.

FIG. 20 illustrates the elastic strip being inserted into one of the openings in the skirt portion.

FIG. 21 illustrates the ends of the inserted elastic strip meeting at a notch in the skirt portion.

DESCRIPTION OF PREFERRED EMBODIMENTS

Figure 1:
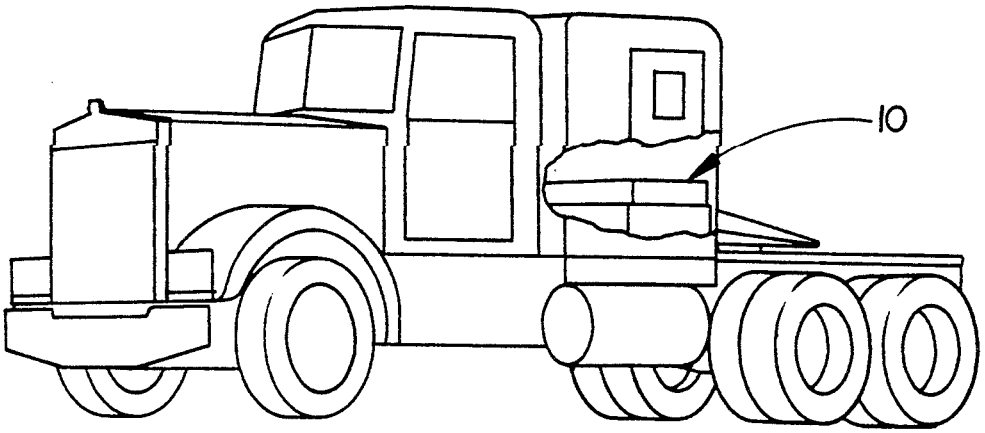
FIG. 1 is a cut away view of the cab of a tractor-trailer showing the present invention on a mattress in back of the driver's seat.

A typical use of the present invention is shown in FIG. 1 wherein the cover assembly is shown on a mattress in the cab of a tractor of a truck.

Figure 2:
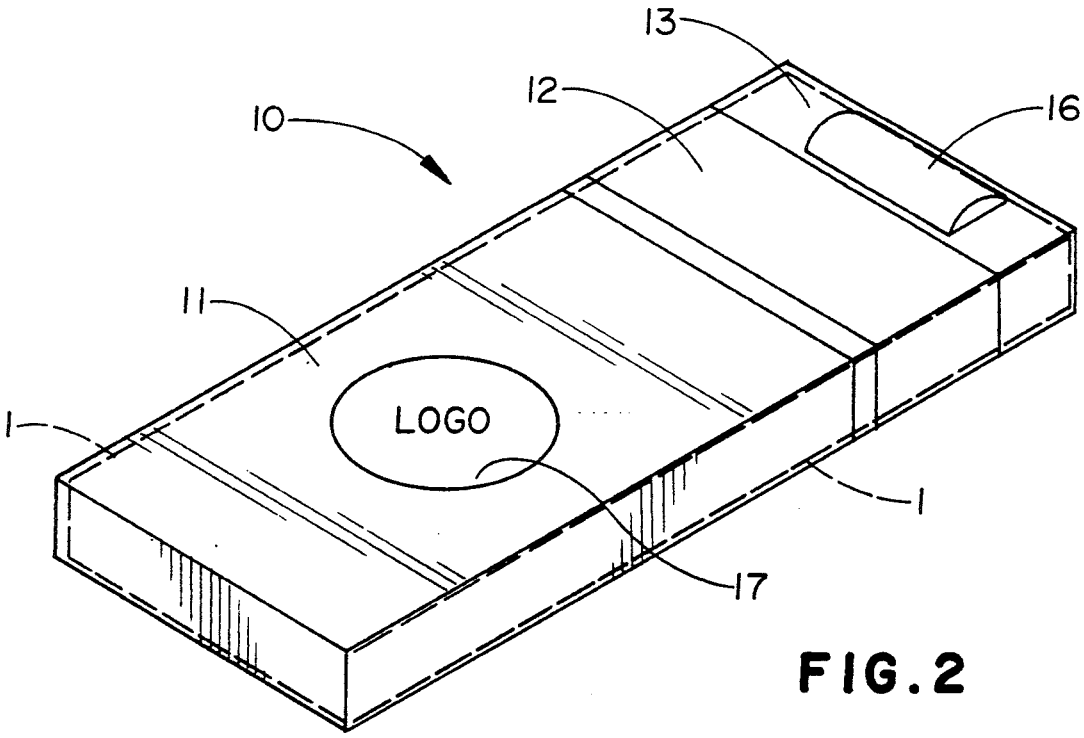
FIG. 2 is a perspective view of the present invention shown on a mattress.
Figure 3A:
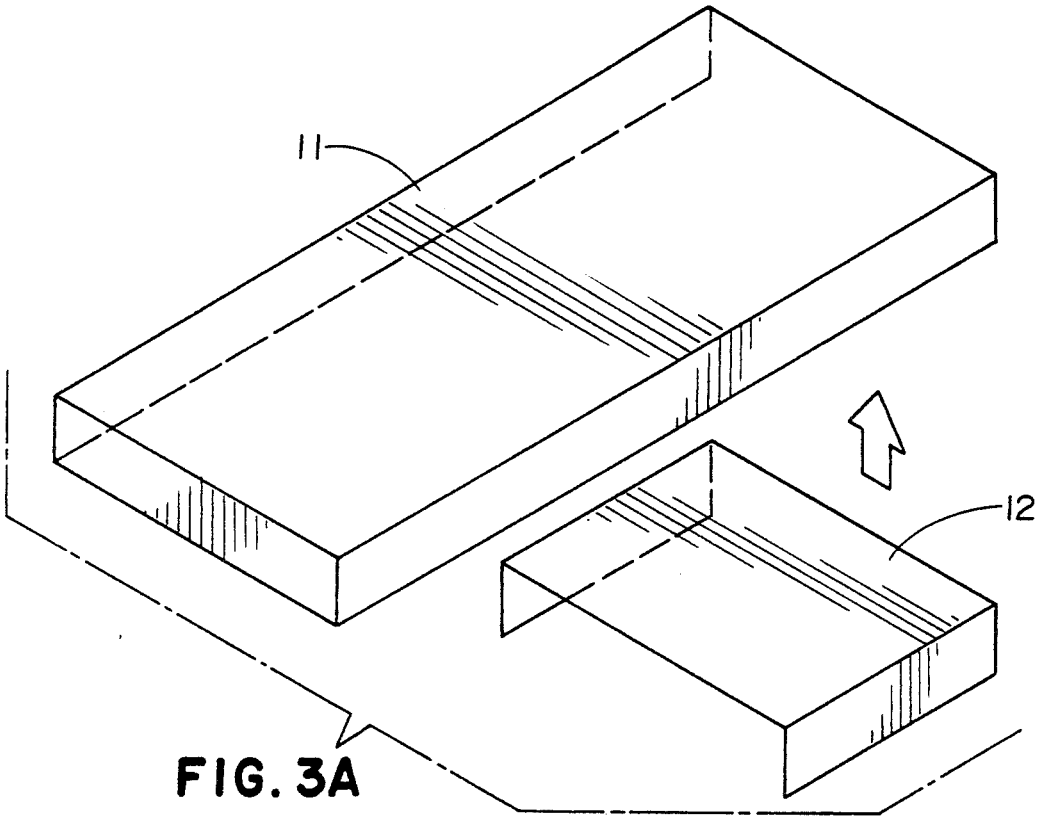
FIGS. 3A–3E illustrate one embodiment of the present invention.
Figure 3B:
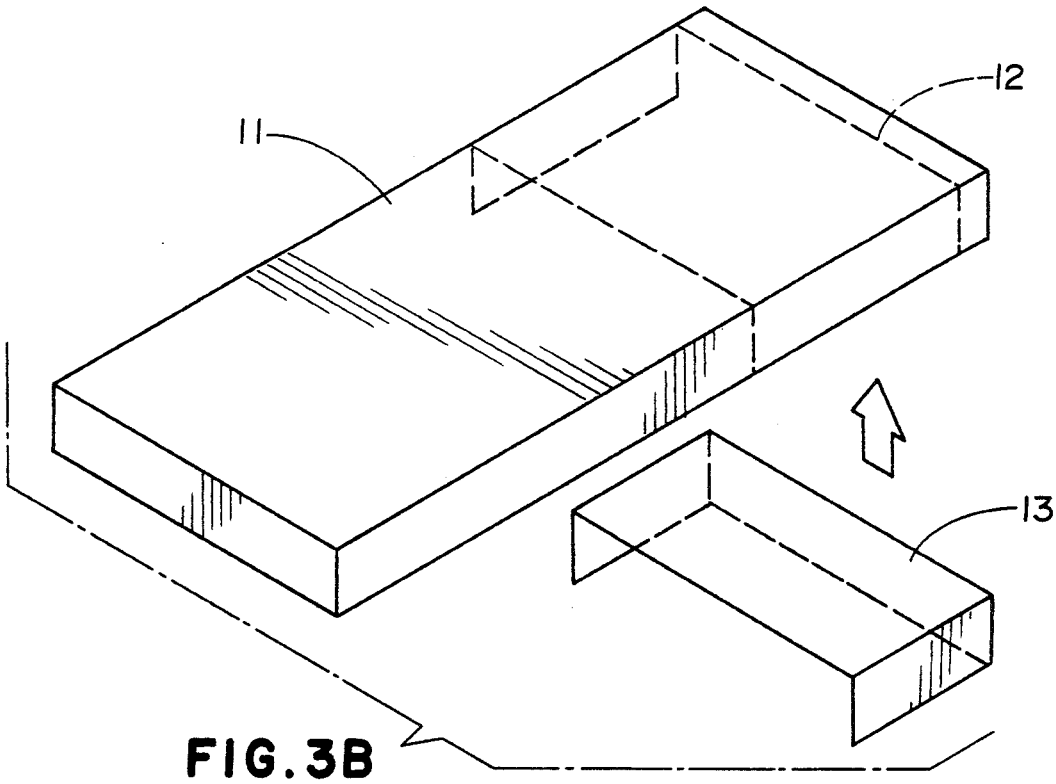
Figure 3C:
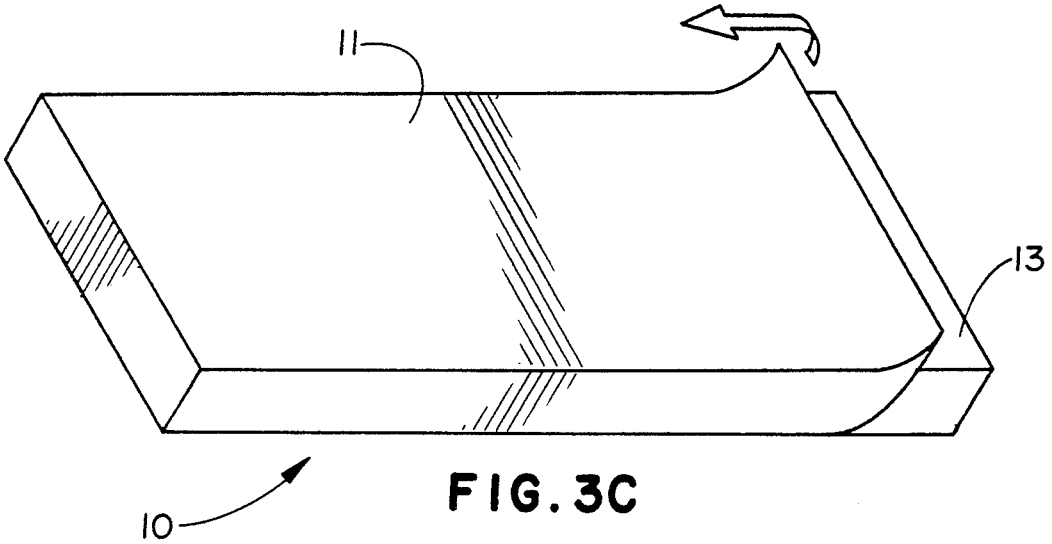
Figure 3D:
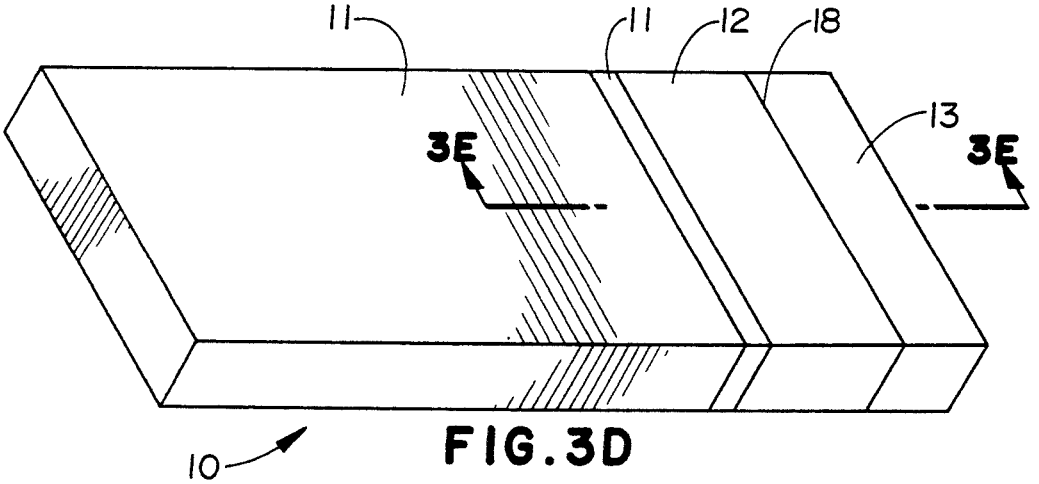
Figure 3E:
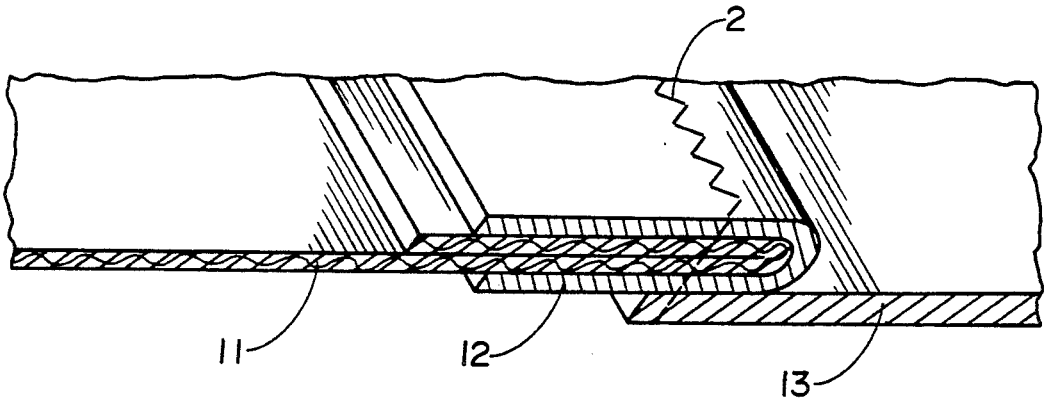

Referring now to FIGS. 2-3E, the cover assembly 10 of the present invention is seen to include a blanket portion 11, a top sheet portion 12 and a bottom sheet portion 13. The cover assembly 10 further includes a skirt portion 14 and an elastic strip 15, shown in FIG. 20. If desired, a pillow portion 16 and decorative emblems 17 may also be provided. The pillow portion 16 would normally be provided at the head end of the mattress, which is located opposite the foot end of the mattress, as best seen in FIG. 2.

The blanket portion 11 has a width and a length. The width and the length of the blanket portion 11 are large enough to exceed the width and the length of the mattress 1 to be covered by the cover assembly 10. In this fashion, the width and the length of the blanket portion 11 extend beyond the periphery of the mattress 1.

The top sheet portion 12 is disposed under the blanket portion 11, being laterally secured, with securing means 2, thereto along a line that extends across the width of the mattress. This line defines a fold line 18 that extends laterally across the width of the blanket portion 11. The top sheet portion 12 has a width that is substantially the same as, and that is substantially aligned with, the blanket portion 11. The top sheet portion 12 has a length that extends rearwardly from the fold line 18 towards the foot end of the mattress 1.

The bottom sheet portion 13 is disposed under the top sheet portion 12. Disposed thusly, the bottom sheet portion 13 is laterally secured, with securing means 2, to the top sheet portion 12 and the blanket portion 11 along the fold line 18. The bottom sheet portion 13 has a width that is substantially the same as, and is substantially aligned with, the blanket portion 11 and the top sheet portion 12. The bottom sheet portion 13 further has a length that extends forwardly from the fold line 18 to beyond the periphery of the top end (the top edge) of the mattress 1.

At least a portion of the blanket portion 11 and the top sheet portion 12 are folded back on themselves along the fold line 18, so as to extend towards the bottom of the mattress 1. In this fashion, the "turned-back" look is provided with the folded back portion of the top sheet portion 12 being disposed on the folded back portion of the blanket portion 11.

Preferably, the respective widths of the blanket portion 11, the top sheet portion 12 and the bottom sheet portion 13 are each greater than the width of the mattress 1. In this fashion, a portion of the widths of the blanket portion 11, the top sheet portion 12 and the bottom sheet portion 13 extend beyond the periphery of the mattress 1 to at least the bottom of the depth of the mattress 1, so that the cover assembly 10 also covers the depth of the mattress 1.

It is further preferred that the length of the blanket portion 11 be slightly longer than the length of the top sheet portion 12. In this manner, the edges of the folded back portion of the blanket portion 11 are visible.

Figure 4B:
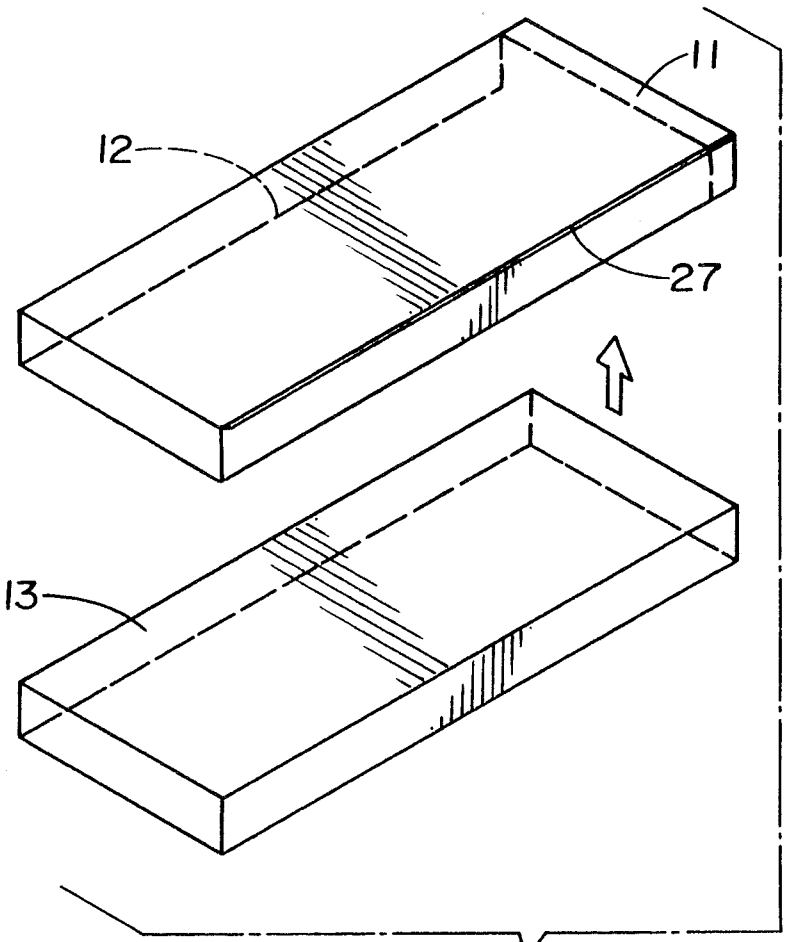
FIGS. 4A–4C illustrate another embodiment of the present invention.
Figure 4A:
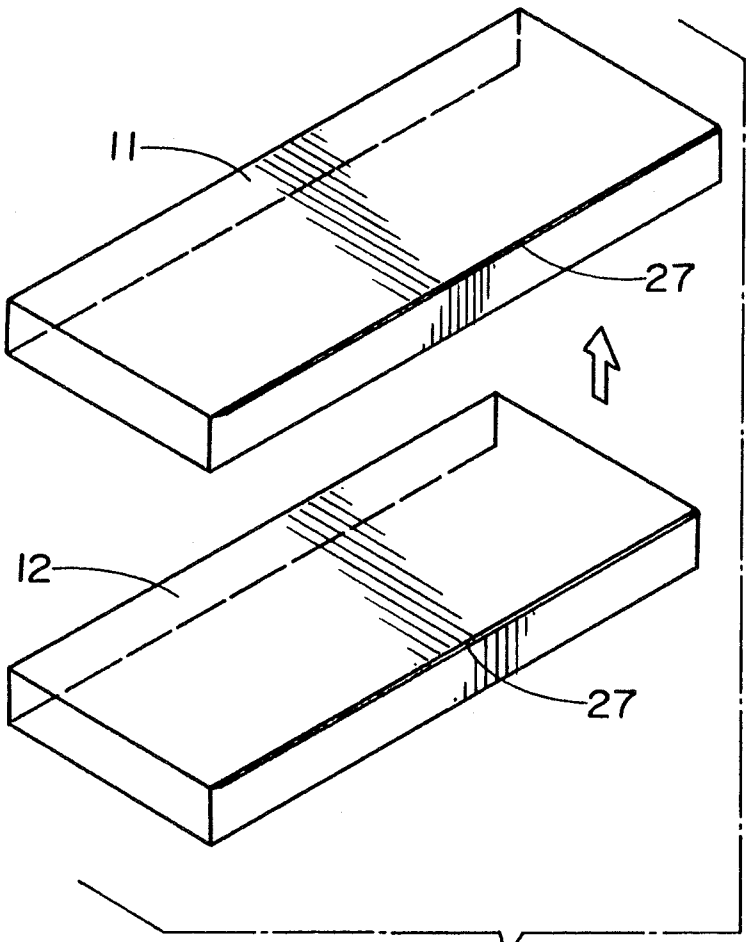
Figure 4C:
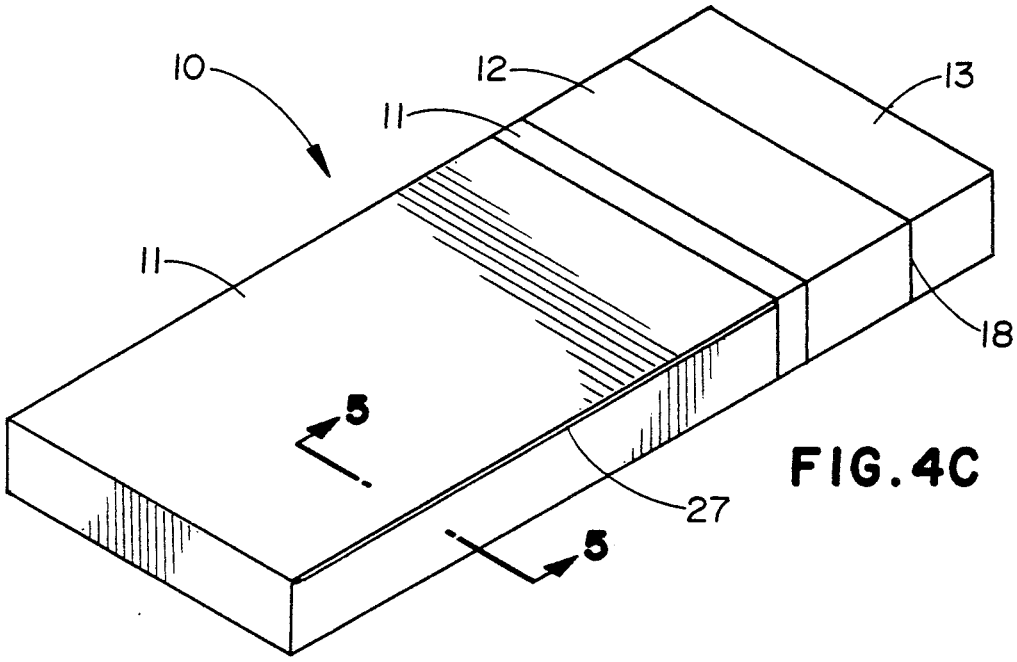

In an alternate embodiment (FIGS. 4A-4C) the top sheet portion 12 has a length extending approximately the length of the blanket portion 11. The blanket portion 11 is slightly longer so as to provide a visible edge when the top sheet portion 12 and blanket portion 11 are folded back. The blanket portion 11 is joined longitudinally to the top sheet portion 12 along the respective edges of the portions. Further, the blanket portion 11 and the top sheet portion 12 each have a pleated fold 27 on at least one side of the respective portion extending the lengths thereof as will be discussed. The bottom sheet portion 13 has a length greater than the mattress 1 and is joined longitudinally to the blanket portion 11 and the top sheet portion 12 at the respective edges thereof. The portions preferably are joined by sewing but other means may be used.

Figure 5:
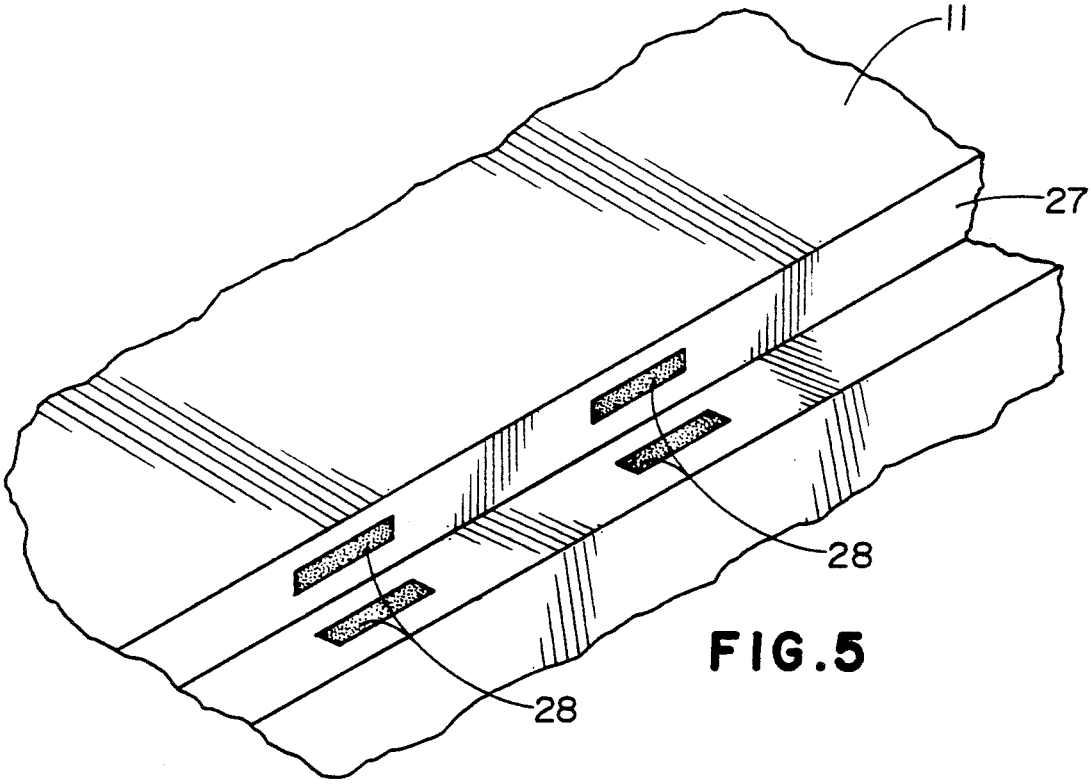
FIG. 5 is a cross-section taken across the lines 5—5 of FIG. 4C.

As more clearly shown (FIG. 5) the pleated fold 27 opens to permit outward expansion of both the blanket portion 11 and the top sheet portion 12. In this manner, a person may be disposed between the top sheet portion 12 and the bottom sheet portion 13 of the cover assembly 10 for sleeping in the cover assembly on the mattress. The pleated folds 27 permit the blanket portion 11 and the top sheet portion 12 to expand sufficiently to accommodate the person's body. The pleated fold 27 is further provided with a plurality of quick release fasteners 28 spaced apart to enable the user to close the pleated fold 26 when the cover assembly 10 is disposed on the mattress 1 so as to improve the appearance of the cover assembly 1. Hook and loop type fasteners are preferred but quick release fasteners of any type may be used.

The skirt portion 14 is disposed about those periphery of the portions of the cover assembly 10 that are not folded back on themselves. In this fashion, the skirt portion 14 extends downwardly covering the depth of the mattress 1. The skirt portion 14 includes an elastic strip 15 that is carried thereby along the length thereof.

If desired, and completing the overall "fully-made", "turned-back" look of the cover assembly 10, a pillow portion 16 is provided. This pillow portion 16 is disposed on the top end of the bottom sheet portion 13, above the turned-back portions of the blanket portion 11 and the top sheet portion 12.

Finally, if desired, a decorative emblem 17 is secured to, and carried by, the blanket portion 11.

Figure 6:
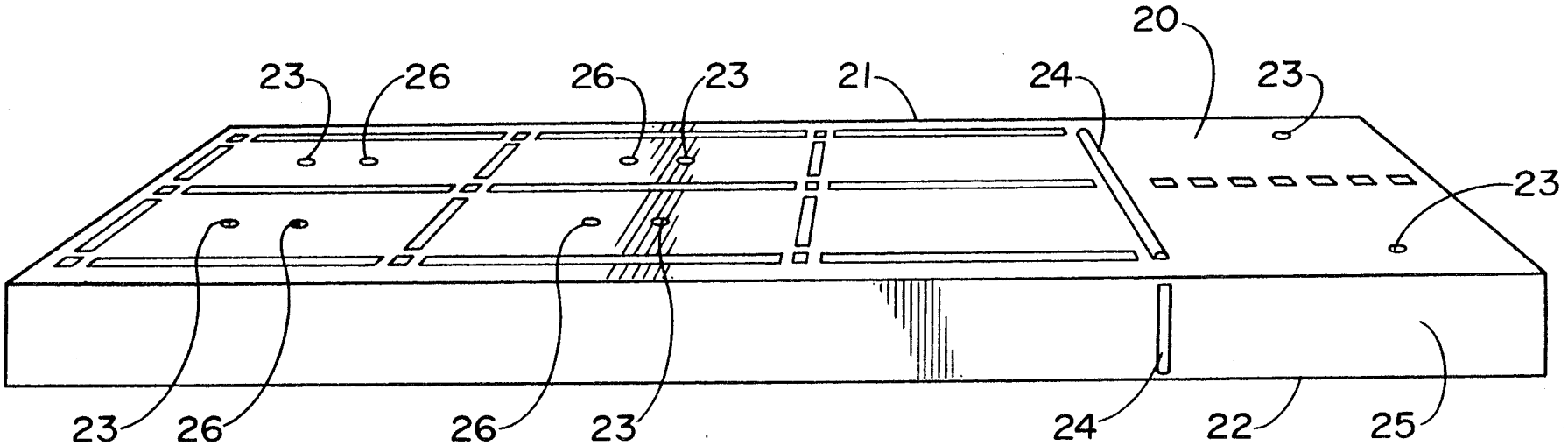
FIG. 6 is a perspective view of the device (prototype) for fabricating the cover assembly of the present invention.

Referring now to FIG. 6, the device (prototype) 20 of the present invention for fabricating the cover assembly 10 of the present invention of FIGS. 3-4 is illustrated.

The device (prototype) 20 includes a top surface 21, a bottom surface 22, a spacing means 23 and a raised member 24.

The top and the bottom surfaces 21 and 22 have substantially the same width and length as the mattress 1 for which the cover assembly 10 is being fabricated. The top and bottom surfaces 21 and 22 are positioned substantially parallel to one another. These surfaces 21 and 22 are spaced apart from one another by a distance that is substantially the same as the depth of the mattress 1. In a preferred embodiment, the surfaces 21 and 22 are $33\frac{1}{3}'' \times 78\frac{1}{2}'' \times \frac{1}{2}''$ in dimension and are disposed $6\frac{3}{4}''$ apart.

The spacing means 23 are provided for spacing and securing the top and bottom surfaces 21 and 22 substantially parallel to one another by a distance. In the preferred embodiment, the spacing means 23 are a plurality of spacing bolts that are vertically disposed between and secured to, the top and bottom surfaces, 21 and 22, respectively. The spacing bolts 23 are further located about the periphery of the prototype 20, being spaced inwardly thereof. In a preferred embodiment, six (6) such bolts 23 are provided being disposed seven inches in one each side and nine inches in at the ends. In this fashion, the bolts 23 define a stop for filler means, such as cloth, 25 that may be disposed between the surfaces 21 and 22, the filler means 25 being wrapped and built up to reach the periphery of the surfaces 21 and 22 for material holding purposes. During fabrication of the cover assembly, as will become more evident below, the fabric 25 holds the various materials of the cover assembly 10 in place while the edges of the surfaces 21 and 22 provide strike points.

The raised member 24 is disposed forwardly of the center of the top surface 21. This raised member 24 is further disposed extending horizontally across the width of the top surface 21 and vertically between the top and bottom surfaces 21 and 22. In this fashion, this raised member 24 provides a marker for a chalk line that may be used for marking the fold line 18 in the cover assembly 10. In a preferred embodiment, this member 24 is a dow stick having a diameter of ¾".

If desired, the top surfaces 21 has a plurality of holes 26 formed therein. Holes 26 define respective touch or feel holes. These touch or feel holes may be used for locating the position where the decorative emblems 17 may be disposed on the cover assembly 10.

Referring now to FIGS. 7–21, the process of the present invention is illustrated, wherein the device 20 is utilized to fabricate the cover assembly 10 of the present invention.

Figure 7:
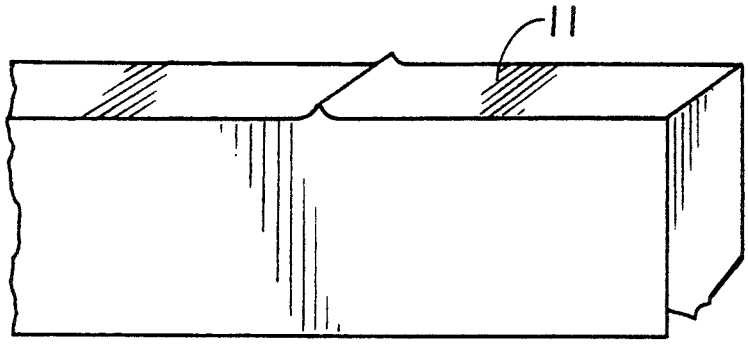
FIGS. 7–21 illustrate the process for fabricating the cover assembly of the present invention with the device (prototype) of the present invention.
Figure 8:
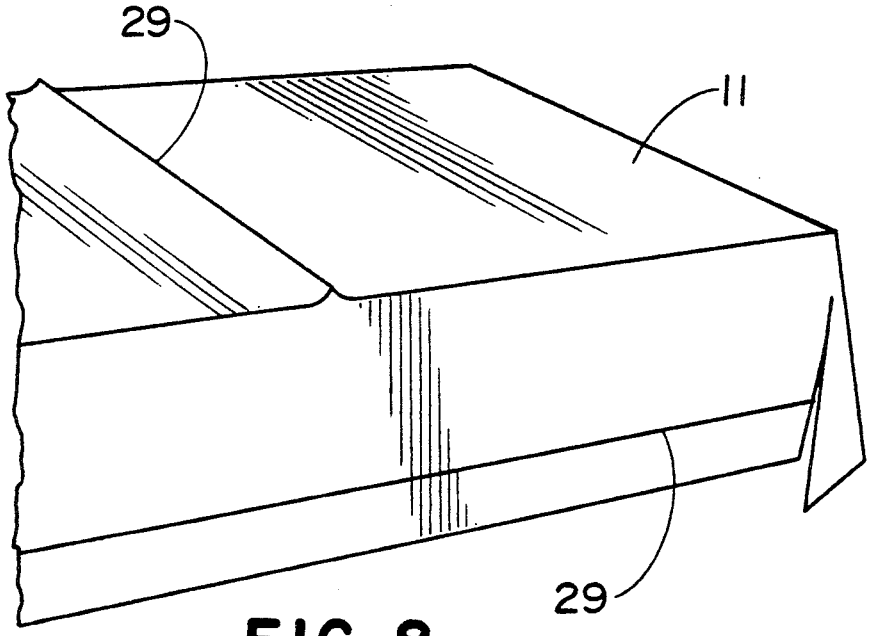
Figure 9:
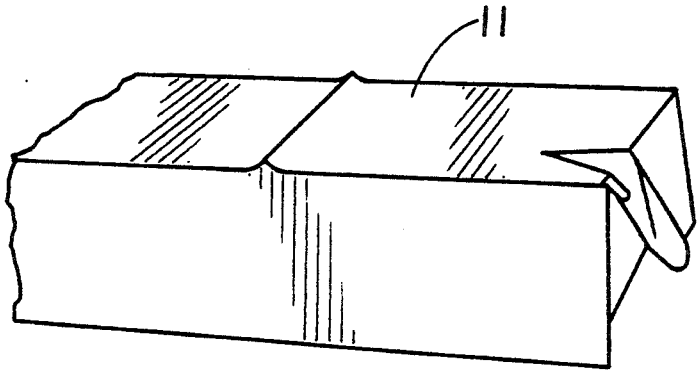

First, the blanket portion 11 is placed upside down on the prototype 20 of the mattress 1 (FIG. 7). The prototype 10 has the same length, width and depth as the mattress. The blanket portion 11 has a width and a length that exceed the length and width of the prototype 20. In this fashion, a portion of the length and width of the blanket portion 11 extend beyond at least a portion of the periphery of the prototype 20 on all sides thereof (FIG. 8). Disposed thusly, the blanket portion 11 is then pinned or otherwise secured in position. This makes the blanket portion 11 more stable and makes further cutting, marking, etc., of the assembly 10 more stable. Further, a chalk line 29 may be made along the edge of the bottom surface 22. As shown in FIG. 9, the corners of the blanket portions 11 are trimmed to remove excess material.

Figure 10:
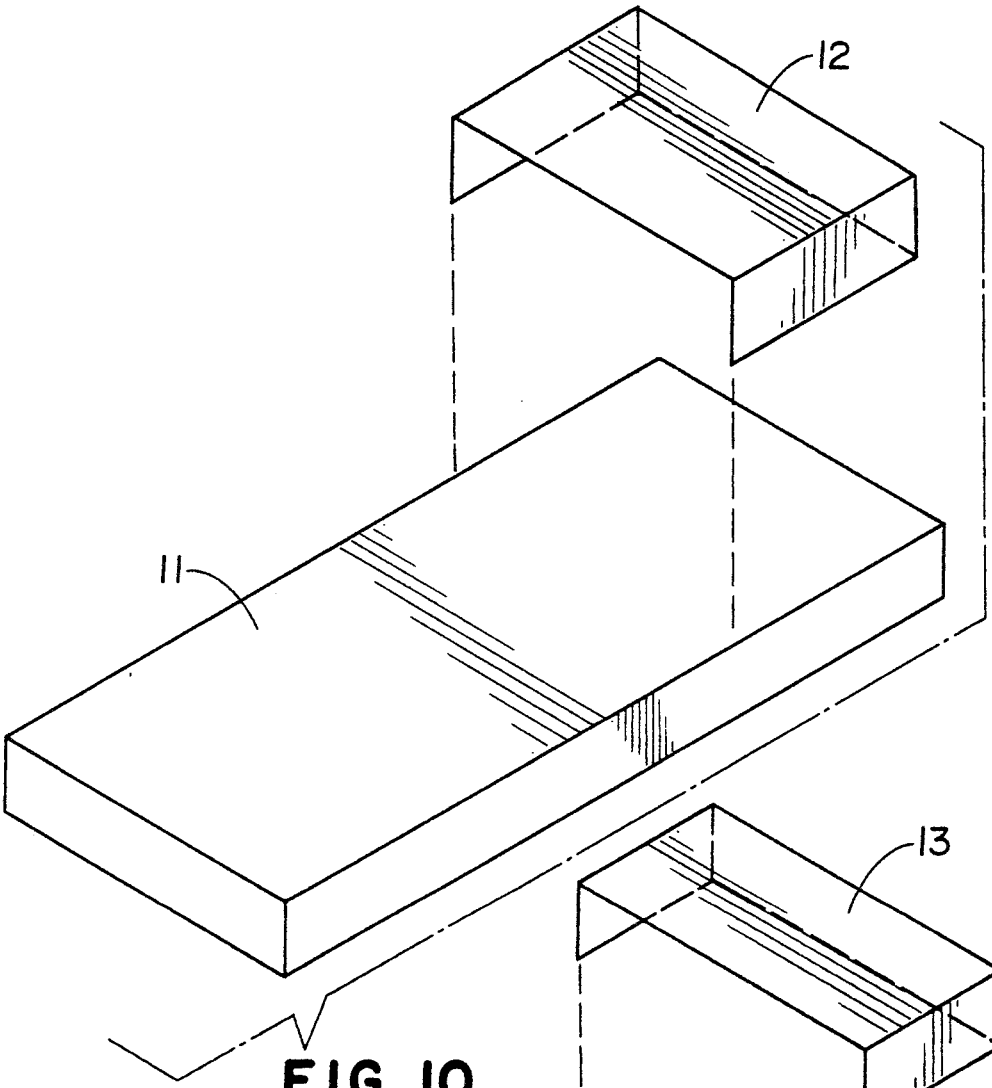

The top sheet portion 12 is placed upside down on the blanket portion 11. In this fashion, the top sheet portion is coincident with the top end (top edge) of the prototype 20. Furthermore, the top sheet portion 12 extends rearwardly from the top end of the prototype 20, terminating forwardly of the center of the prototype 20 (FIG. 10).

Figure 11:
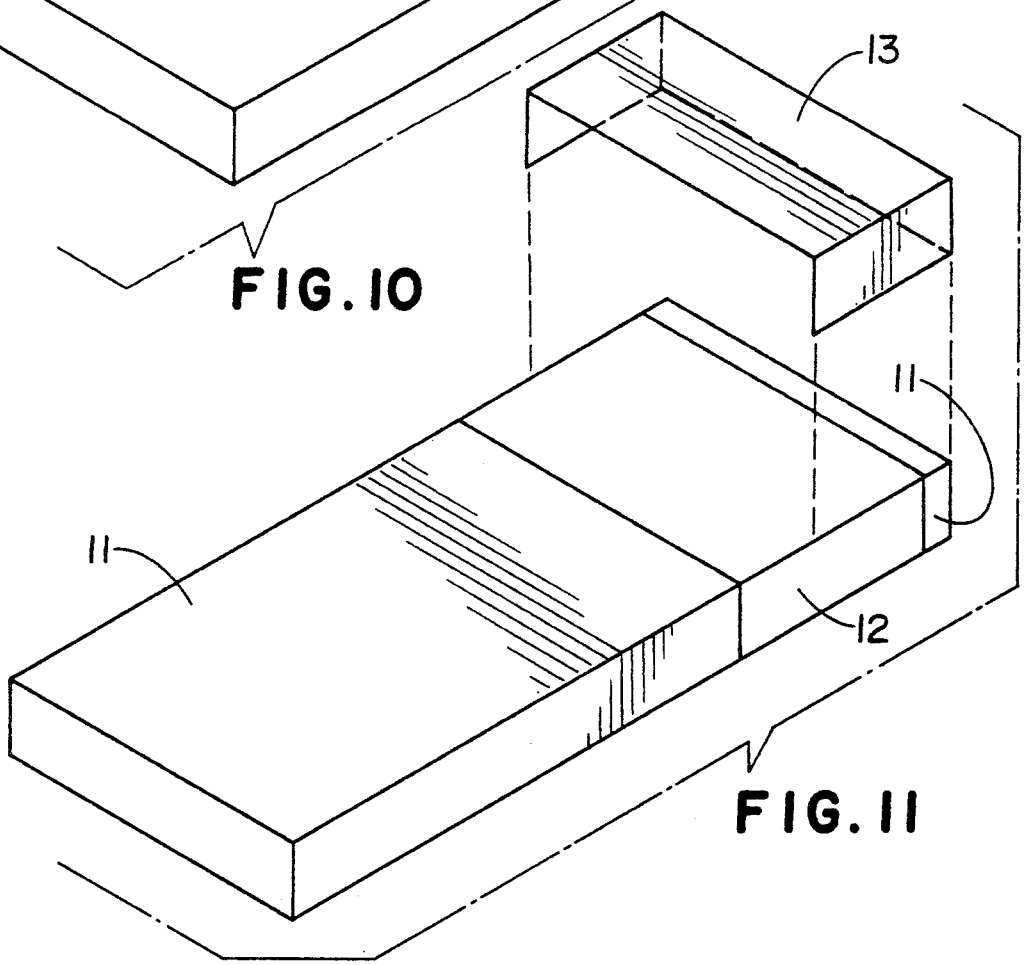

The bottom sheet portion 13 is placed upside down on the blanket portion 11 and the top sheet portion 12. Disposed thusly, the bottom sheet portion 13 extends forwardly and extends beyond at least a portion of the periphery of the prototype 20 (FIG. 11).

Once placed on the prototype 20, as described above, the portions 11–13 may be marked with a chalk line using the raised dow (of the fold line 18) as a marker similarly to the marking made on the blanket portion (FIG. 8). Further, chalk lines are made about the portions 11–13 of the assembly 10 using the edge (periphery) of the bottom surface 22 of the device 20, as a marker.

With the portions 11–13 disposed as described above, the blanket portion 11, top sheet portion 12 and the bottom sheet portion 13 are secured to one another along the marked fold line 18 that is located forwardly of the center of the prototype 20. The fold line 18 is further located extending across the width of the prototype 20.

Figure 15:
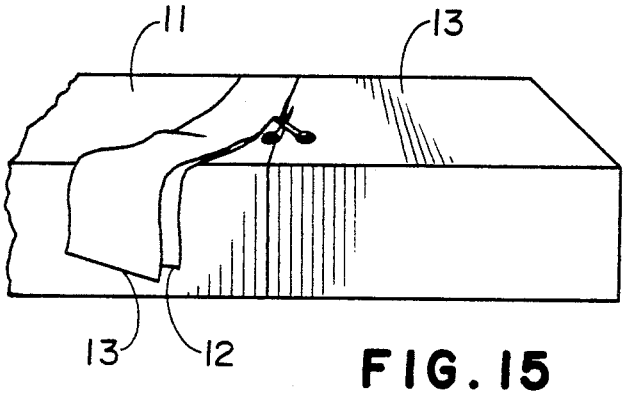
Figure 16:
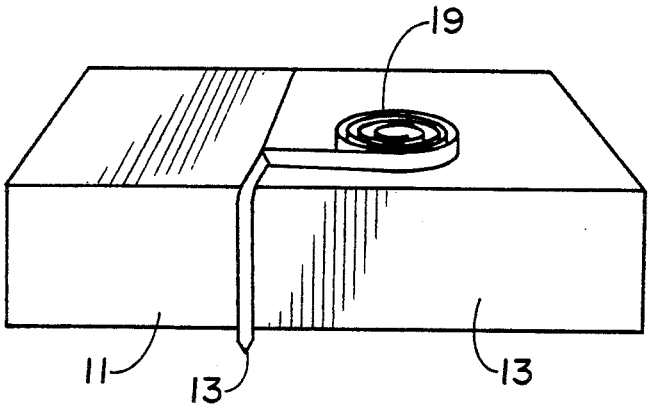
Figure 17:
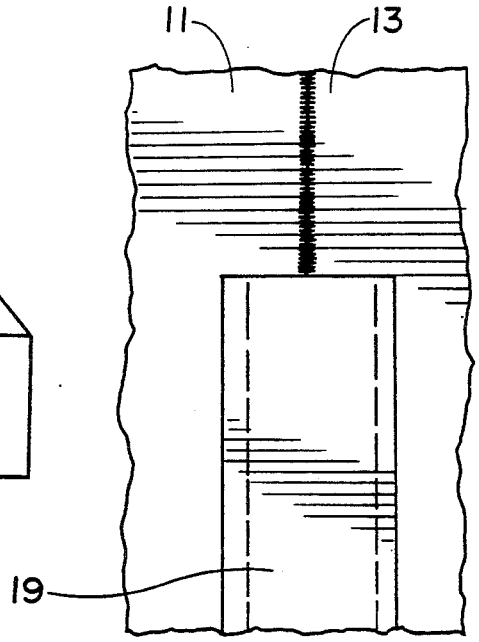

It is noted here how the portions 12 and 13 are of a length, so as to extend rearwardly beyond the fold line 18. In this respect, the material of portions 12 and 13 are longer than the length from the fold line 18 to the top edge of the prototype 20. Provision of such an excessive length insures that enough fabric is provided to reach the fold (seam) line located at the raised dow, without the burden of measuring too short a portion. Further in this regard, in a preferred embodiment, the top sheet portion 12 is at least 22 inches long while the bottom sheet 13 is at least 29 inches long. Excess material of the top sheet portion 11 and of the bottom sheet portion 13 are removed (FIG. 15). A reinforcement strip 19 is disposed so as to straddle the interface of the top sheet portion 11 and the bottom sheet portion 12 with the blanket portion 11 and the reinforcement strip 19 is sewn in place on both sides of the interface (FIGS. 16–17).

Figure 12:
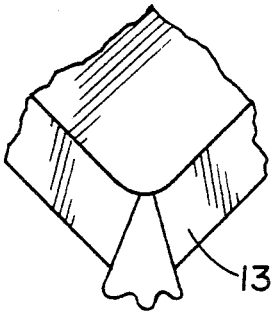
Figure 13:
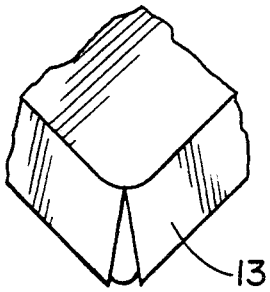
Figure 14:
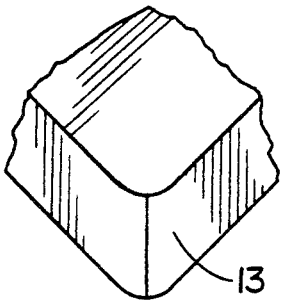

Those portions of the blanket portion 11 that are located extending beyond the periphery of the bottom end (bottom edge) of the prototype 20 and those portions of the bottom sheet 13 that are located extending beyond the periphery of the top end of the prototype 20, are pulled towards the respective corners of the prototype 20 (FIG. 11). In this manner, corner excess material is defined by those portions of the blanket portion 11 and top sheet portion 12 that extend beyond the corners of the prototype. This excess corner material is then marked and removed therefrom by any suitable means, such as cutting, etc. (FIGS. 12–14).

The remaining portions of the blanket portion 11 and the top sheet portion 12 that are located at the corners of the prototype 20 are then secured to one another. In this fashion, the respective corner seams are formed.

Figure 18:
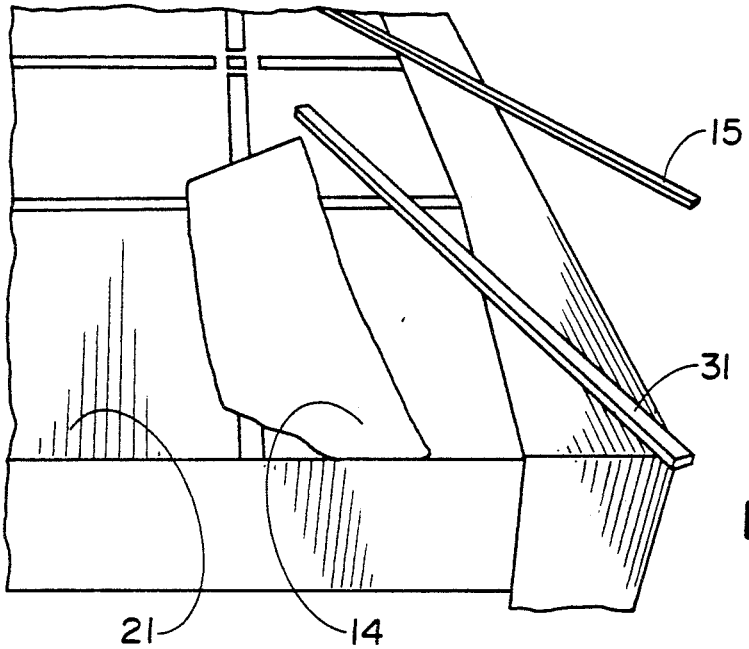

With reference now to FIG. 18, the skirt portion 14 is made up of four (4) separate strips (one for each side and one for each end of the cover assembly 10) of material, each of which, in a preferred embodiment, is eight inches wide. Each strip is marked with a chalk line that is, preferably, 1½" wide, using a yardstick's 31 thickness for simplification. Note also that the square ends have been measured and cut on an outward angle six (6) inches to form the ends necessary for continuity at the four corners.

Figure 19:
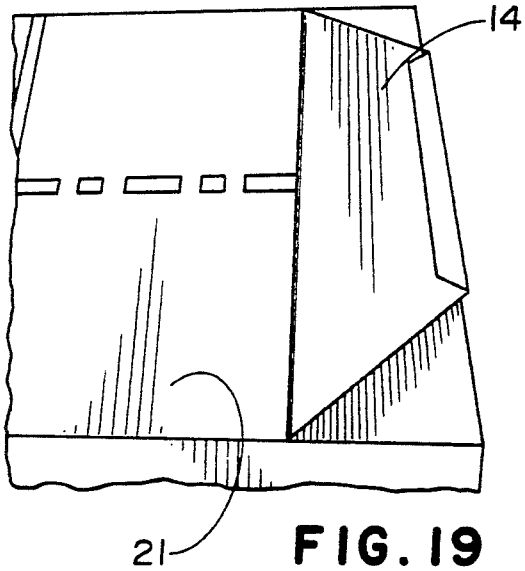

The ends of the four strips of the skirt portion 14 are folded and pinned at their respective chalk lines and the back portions thereof are sewn at the pin head sides. This will later provide the beginning of an opening for receiving the elastic strip 15, as shall be discussed later. Preferably, the bottom or foot end of the fabrics should be notched out in the middle for retrieving the elastic later when their ends meet. However, as noted, care must be taken so as not to cut the seam line. Once the beginning of the opening is formed, the length of the strips are folded back on themselves along the chalk line, being pinned and then sewn close to the end (preferably about 14") for forming the opening in the skirt 14 that is to receive the elastic strip 15 therein (FIG. 19).

The various strips of the skirt portion 14 are then secured about the periphery of the cover assembly 10 that is not folded back on itself. Secured thusly, the strips of the skirt portion 14 that are disposed on the sides of the assembly 10 begin at the single bottom sheet portion 13 and then pick up the top sheet portion 12 and the blanket portion 11, ending at the foot of the prototype 20 where they are attached to the blanket portion 11. In this fashion, the skirt 14 extends downwardly from the remainder of the cover assembly 10, covering the depth of the prototype 20. The skirt portion 14 includes the opening that is formed therein extending along the length of the periphery thereof.

It is further noted that, in dealing with fabric edges, unevenness and a high degree of flexibility usually results. A cut along the quarter inch seam of the skirt 14 will nonetheless still result in the proper look and fit.

The strips of the skirt portion 14, once pinned and sewn to the assembly 10 back-to-back are then trimmed of any unevenness that might exist. The seams between the adjacent strips of the skirt 14 are then sewn together forming the skirt 14.

The elastic strip 15 is then disposed in the opening that extends about the length of the skirt portion 14, such that the elastic strip 15 is carried thereby being secured about the length of the skirt portion 14. In this fashion, a retainer is provided for the cover assembly 10 on the mattress is provided.

In a preferred embodiment, the elastic strip 15 is a ½" wide elastic.

Figure 20:
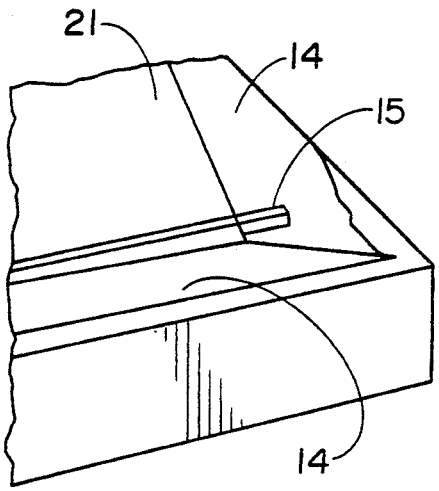
Figure 21:
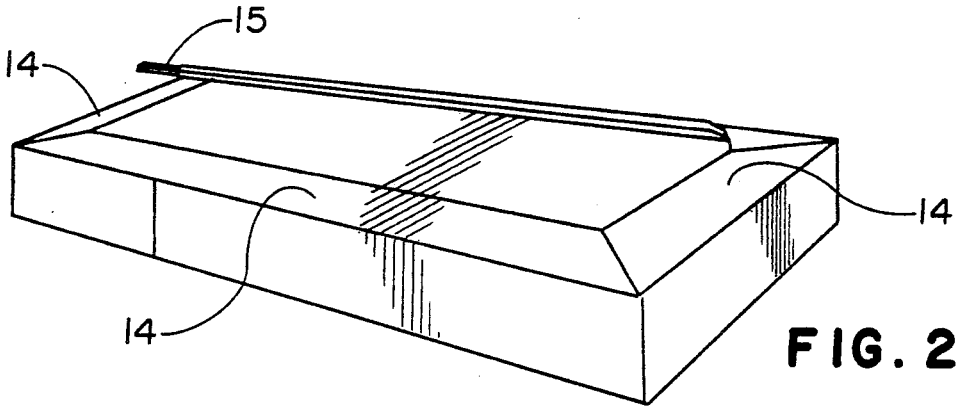

With reference now to FIG. 20, the elastic strip 15 is inserted into the opening by means of pinning one end of the elastic strip 15 to a softboard that has a width that is smaller than the width of the yardstick that was used on the strips of the skirt portion 14. In the preferred embodiment, this softboard is a batten strip. Once the elastic strip 15 is inserted through one of the openings, it is restrained and the stick is removed and redirected. The elastic strip 15 is then repinned and the process is repeated until the elastic ends meet at the notch (FIG. 21). These ends of the elastic strip 15 are then pulled taut, sewn at the point (realizing a snug fit) and the excess is trimmed. It is noted here that this permits ease in the threading process of the elastic strip 15. The soft batten strip provides a good surface for sticking the pin into the elastic strip 15 and guiding it through the opening. It is also ideal for providing the necessary length, stability and flexibility when working in limited places. If desired, a center hook may also be provided for drawing in the sides.

In the above manner, a cover assembly 10 for a mattress 1 is formed. When turned right-side up and placed on the mattress 1 (as seen in FIG. 2), at least a portion of the blanket portion 11 and the top sheet portion 12 are folded back on themselves along the fold line 18 and towards the bottom of the mattress 1. This provides a "turned-back" look with the folded back portion of the top sheet portion 12 disposed on the folded back portion of the blanket portion 11.

Finally, if desired, using the touch holes in the top surface 21 as a guide, the decorative emblems 17 may then be sewn to the top of, preferably, the blanket portion 11.

Obviously, many modifications may be made without departing from the basic spirit of the present invention. Accordingly, it will be appreciated by those skilled in the art, that within the scope of the appended claims, the invention may be practiced other than has been specifically described herein.

What is claimed is:

1. A one-piece cover assembly for a mattress, the mattress having a width, a length, a center, a top end and a periphery, the cover assembly comprising:

a blanket portion having a width exceeding the width of the mattress, such that the width of the blanket portion extends beyond the periphery of the mattress, the blanket portion further having a length exceeding the length of the mattress, such that at least a portion of the length of the blanket portion extends beyond at least a portion of the periphery of the mattress;

a top sheet portion disposed under the blanket portion and laterally secured thereto along a line extending across the width of the mattress forwardly of the center of the mattress, whereby a fold line is defined extending laterally across the width of the blanket portion, the top sheet portion having a width being substantially the same as and substantially aligned with the blanket portion, the top sheet portion having a length extending rearwardly from the fold line to the top end of the mattress;

a bottom sheet portion disposed under the top sheet portion and laterally secured to the blanket portion and the top sheet portion along the fold line, the bottom sheet portion having a width being substantially the same and substantially aligned with the blanket portion and the top sheet portion, the bottom sheet portion further having a length extending forwardly of the fold line beyond the periphery of the top end of the mattress;

wherein at least a portion of the blanket portion and the top sheet portion are folded back on themselves along the fold line and towards the bottom of the mattress, such that a fully made, "turned back" look is provided with the folded back portion of the top sheet portion being disposed on the folded back portion of the blanket portion.

2. The cover assembly of claim 1, wherein the mattress further has a depth, and further wherein the respective widths of the blanket, top sheet and bottom sheet portions are each greater than the width of the mattress, such that a portion of the widths of the blanket, top sheet and bottom sheet portions extend beyond the periphery of the mattress to at least the bottom of the depth of the mattress, whereby the cover assembly also covers the depth of the mattress.

3. The cover assembly of claim 1, wherein the length of the blanket portion is slightly longer than the top sheet portion, such that the edges of the folded back portion of the blanket portion are visible.

4. The cover assembly of claim 1, further comprised of:

a skirt portion disposed about the periphery of the portions of the cover assembly that are not folded back on themselves, so as to extend downwardly therefrom covering the depth of the mattress.

5. The cover assembly of claim 4, wherein the skirt portion includes an elastic strip carried thereby along the length of the skirt portion for retaining the cover assembly on the mattress.

6. The cover assembly of claim 5, further comprised of:

a pillow portion disposed on the cover assembly for completely simulating a fully made bed.

7. The cover assembly of claim 1, further comprised of:

a decorative emblem secured to and carried by the blanket portion.

8. A one-piece cover assembly for a mattress, the mattress having a width, a length, a depth, a center, a top end and a periphery, the cover assembly comprising:

a blanket portion having a width exceeding the width of the mattress, such that the width of the blanket portion extends beyond the periphery of the mattress at least to the bottom of the depth of the mattress, such that the blanket portion also covers the depth of the mattress, the blanket portion further having a length exceeding the length of the mattress, such that at least a portion of the length of the blanket portion extends beyond at least a portion of the periphery of the mattress;

a top sheet portion disposed under the blanket portion and laterally secured thereto along a line extending across the width of the mattress forwardly of the center of the mattress, whereby a fold line is defined extending laterally across the width of the blanket portion, the top sheet portion having a width being substantially the same as and substantially aligned with the blanket portion, the top sheet portion having a length extending rearwardly from the fold line towards the foot end of the mattress;

a bottom sheet portion disposed under the top sheet portion and laterally secured to the blanket portion and the top sheet portion along the fold line, the bottom sheet portion having a width being substantially the same and substantially aligned with the blanket portion and the top sheet portion, the bottom sheet portion further having a length extending forwardly of the fold line beyond the periphery of the top end of the mattress; and a skirt portion disposed about the periphery of the portions of the cover assembly that are not folded back on themselves, so as to extend downwardly therefrom covering the depth of the mattress;

wherein at least a portion of the blanket portion and the top sheet portion are folded back on themselves along the fold line and towards the bottom of the mattress, such that a fully made, "turned back" look is provided with the folded back portion of the top sheet portion being disposed on the folded back portion of the blanket portion.

9. A one-piece cover assembly for a mattress, the mattress having a width, a length, a depth, a center, a top end and a periphery, the cover assembly comprising:

a blanket portion having a width exceeding the width of the mattress, such that the width of the blanket portion hangs down beyond the periphery of the mattress at least to the bottom of the depth of the mattress, such that the blanket portion also covers the depth of the mattress, the blanket portion further having a length exceeding the length of the mattress, such that at least a portion of the length of the blanket portion hangs down beyond at least a portion of the periphery of the mattress;

a top sheet portion disposed under the blanket portion and laterally secured thereto along a line extending across the width of the mattress forwardly of the center of the mattress, whereby a fold line is defined extending laterally across the width of the blanket portion, the top sheet portion having a width being substantially the same as and substantially aligned with the blanket portion, the top sheet portion having a length extending rearwardly from the fold line towards the foot end of the mattress;

a bottom sheet portion disposed under the top sheet portion and laterally secured to the blanket portion and the top sheet portion along the fold line, the bottom sheet portion having a width being substantially the same and substantially aligned with the blanket portion and the top sheet portion, the bottom sheet portion further having a length extending forwardly of the fold line beyond the periphery of the top end of the mattress; and a skirt portion disposed about the periphery of the portions of the cover assembly that are not folded back on themselves, so as to extend downwardly therefrom covering the depth of the mattress, the skirt portion including an elastic strip that is carried thereby extending along the length of the skirt portion for retaining the cover assembly on the mattress;

wherein at least a portion of the blanket portion and the top sheet portion are folded back on themselves along the fold line and towards the bottom of the mattress, such that a fully made, "turned back" look is provided with the folded back portion of the top sheet portion being disposed on the folded back portion of the blanket portion.

* * * * *